United States Patent [19]

Callais, Jr.

[11] 4,375,733

[45] Mar. 8, 1983

[54] BLEEDING MONSTER TOY

[76] Inventor: Ivan G. Callais, Jr., 3413 Bissonet Dr., Metairie, La. 70002

[21] Appl. No.: 272,725

[22] Filed: Jun. 11, 1981

[51] Int. Cl.[3] ..... A63H 13/00

[52] U.S. Cl. ..... 46/116; 46/164

[58] Field of Search ..... 46/135 R, 164, 156, 46/11, 116, 115, 135 A, 1 R; 272/8 R, 8 N

[56] References Cited

U.S. PATENT DOCUMENTS

| | | | |
|---|---|---|---|
| 2,532,729 | 12/1950 | Millstein | 46/11 |
| 2,668,394 | 2/1954 | Auzin | 46/135 R |
| 3,105,612 | 10/1963 | Krasnoff et al. | 46/116 X |
| 3,590,515 | 7/1971 | Clark et al. | 46/44 X |
| 4,192,512 | 3/1980 | Erickson et al. | 46/151 X |

FOREIGN PATENT DOCUMENTS

| | | | |
|---|---|---|---|
| 1107571 | 5/1961 | Fed. Rep. of Germany | 46/135 A |

*Primary Examiner*—Mickey Yu

*Attorney, Agent, or Firm*—C. Emmett Pugh & Associates

[57] ABSTRACT

A figure toy or doll with a hollow body cavity fabricated from a durable and resilient material. Fitted to the body is a relatively rigid extension which incorporates a threaded arrangement to receive a relatively rigid head which incorporates a reciprocal threaded arrangement. The hollow body is filled with a non-toxic gelatinous fluid, which, when the body is compressed, will flow through the relatively rigid extension into the relatively rigid head and out of orifices in the head. This configuration simulates bleeding by the figure toy. During shipping, the relatively rigid extension is sealed with for example an easily removeable foil or film to prevent inadvertent discharge of the gelatinous fluid.

8 Claims, 3 Drawing Figures

BLEEDING MONSTER TOY

BACKGROUND OF THE INVENTION

1. Field of the Invention

This invention relates generally to the field of figure toys or dolls and more particularly to the figure toys or dolls which discharge a fluid.

2. Prior Art

The prior art has included teachings of a knife or bayonet which discharges a fluid to simulate bleeding (note for example U.S. Pat. No. 2,826,859 to J. E. Shaffer, issued Mar. 18, 1958), doll heads which change complexion by simple manipulation of position to simulate illness (note for example U.S. Pat. No. 2,931,136 to E. M. Loewy, issued Apr. 5, 1960) and an apparatus which adheres to a figure toy device to simulate injury (note for example U.S. Pat. No. 3,858,351 to I. C. Porter, issued Jan. 7, 1975). In addition, there are dolls available on the market which discharge fluids to simulate a body function, such as tearing and wetting.

The present invention exemplifies the new and unobvious art of a figure toy or doll which discharges a fluid from orifices of the head, to simulate bleeding due to injuries resulting or occasioned by compression of the body.

3. Summary Discussion of Invention

It is therefore an object of the present invention to provide a figure toy or doll which will discharge fluid from orifices in the head when the body is compressed.

It is another object of this invention to provide a figure toy or doll which possess a hollow body cavity which stores the fluid to be discharged.

It is still another object of this invention to provide a figure toy or doll which possesses a head removable from the body to permit the filling of the body cavity which stores the fluid to be discharged.

It is still another object of this invention to provide a gelatinous fluid which may be collected after discharge from orifices in the head and returned to the body cavity for reuse.

BRIEF DESCRIPTION OF THE DRAWINGS

Other objects and advantages of the present invention and a full understanding thereof may be had by referring to the following detailed description and claims, taken together with the accompanying drawing briefly described below in which like parts are given like reference numerals.

DETAILED DESCRIPTION OF THE PREFERRED EMBODIMENT

Figure 2:
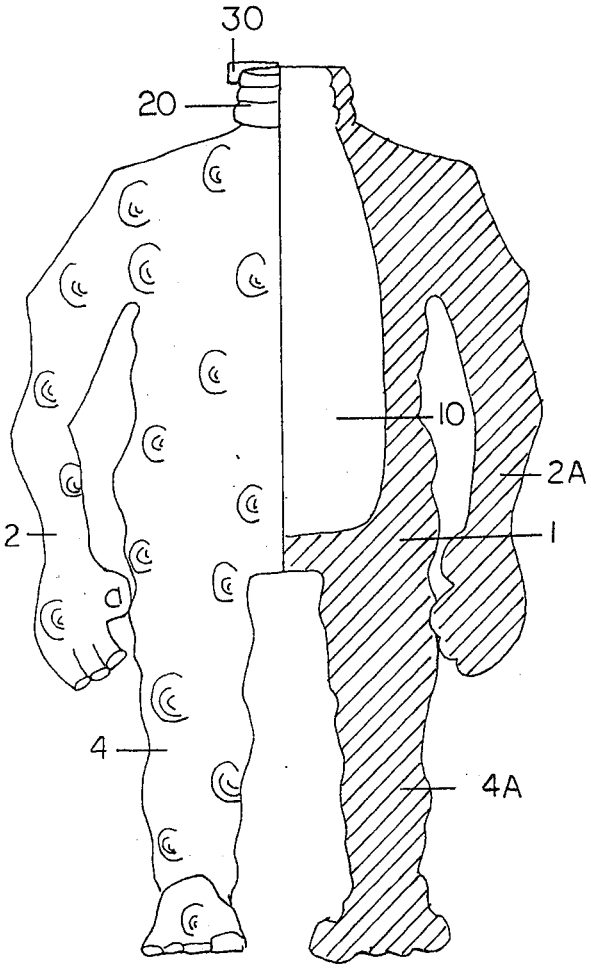
FIG. 2 is a frontal view of the body of the preferred embodiment of the present invention which presents a cut-a-way to reveal the body cavity in which the gelatinous fluid is stored.
Figure 3:
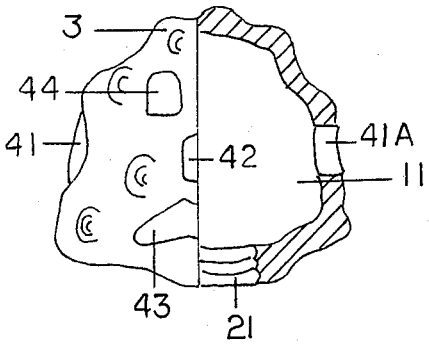
FIG. 3 is a frontal view of the head of the preferred embodiment of the present invention which presents a cut-a-way to reveal the head cavity which receives the gelatinous fluid prior to its discharge from orifices in the head.
Figure 1:
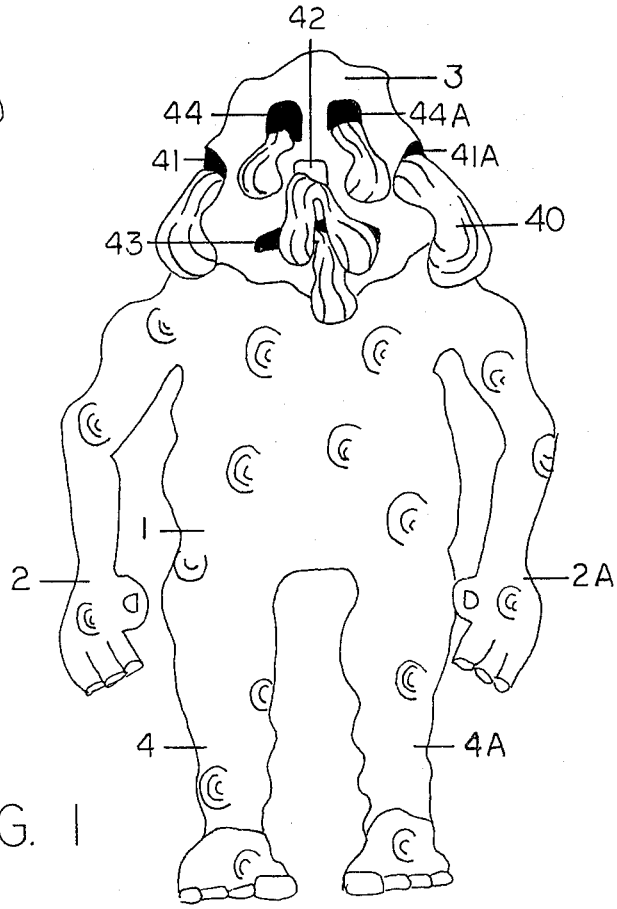
FIG. 1 is a frontal view of the preferred embodiment of the present invention depicting its overall characteristics.

The preferred embodiment of the figure toy device of the present invention is shown in FIGS. 1 through 3.

Structure

FIG. 1 depicts a representative generalized configuration of the preferred embodiment of the present invention comprised of a body of for example a biped consisting of a torso 1 and extremities 2, 2A, for example the arms of a biped, and 4, 4A, for example the legs of a biped, fabricated from a durable and resilient material, and a head 3 fabricated from a relatively rigid material with a non-toxic gelatinous fluid 40 oozing from orifices in the head 3, for example the aural, nasal, oral and optic orifices.

FIG. 2 discloses the body cavity 10 provided in the torso 1 to store the non-toxic gelatinous fluid 40. The extremities 2, 2A for example the arms of a biped and 4, 4A for example the legs of a biped are of solid construction. The body is fitted with a relatively rigid extension 20 which incorporates the securing means, for example external threads, to receive the head 3. The relatively rigid extension 20 is covered with a sealing material 30, for example foil, which closes off the body cavity 10 and prevents the inadvertent discharge of the non-toxic gelatinous fluid 40.

FIG. 3 discloses the head cavity 11 provided in the head 3 to receive the non-toxic gelatinous fluid 40 from the body cavity 10. The non-toxic gelatinous fluid 40 is discharged through the aural 41, 41A, nasal 42, oral 43, and optic 44, 44A orifices in the head 3. The base of the head 21 incorporates securing means, for example internal threads, reciprocal to the securing means incorporated in the relatively rigid extension 20 fitted to the body to mate therewith.

Use

The use of the figure toy or doll of the present invention will now be described. A non-toxic gelatinous fluid 40 is placed in the body cavity 10 and the cavity is covered with a sealing material 30 to prevent the accidental discharge of the non-toxic gelatinous fluid 40 during transit and storage prior to the figure toy or doll being placed in possession of the user. The head 3 is secured to the body by means of a relatively rigid extension 20.

To use the toy, the user first removes the head 3 from the body 1 to expose the sealing material 30, then moves the sealing material and then returns the head 3 to the body 1. The figure toy or doll is now ready to function as intended.

If the user now compresses the body 1 of the figure toy or doll, the non-toxic gelatinous fluid 40 will be forced through the relatively rigid extension 20 and into the head cavity 11. By continuing to compress the body 1 of the figure toy or doll, the user will force into the head cavity 11 a quantity of non-toxic gelatinous fluid 40 which is greater than the capacity of the head cavity 11, thereby forcing the non-toxic gelatinous fluid 40 to ooze from the orifices of the head 3, for example the aural 41, 41A, nasal 42, oral 43, and optic 44, 44A orifices.

Once the compressive pressure on the body 1 is released, the body will return to its original configuration.

The head 3 may be removed from the body 1 to expose the relatively rigid extension 20 fitted to the body 1. The non-toxic gelatinous fluid 40 which oozed from the orifices of the head 3 may be collected for reuse and returned to the body cavity 10 through the relatively rigid extension 20 fitted to the body 1. The head 3 is then returned to the body 1 and the figure toy device is ready for another use.

The above evolution may be repeated at the pleasure of the user.

What is claimed is:

1. A figure toy, comprising:

a humanoid, monster-type body of durable, flexible and resilient material, said body having an internal body cavity;

a humanoid head portion of a relatively rigid material, said head portion having an internal head cavity in fluid communication with said body cavity and a series of head portion orifices communicating with said head cavity and located in analogous positions to at least two of the head orificies of the humanoid figure including the aural, nasal, oral, and optic areas;

a relatively rigid extension fitted to said body, said rigid extension having head securing means for receiving and holding said head portion;

a body securing means in the base of said head portion for mating and joining said head portion with said relatively rigid extension; and a colored, non-toxic, gelatinous fluid contained within said body cavity; the compressing of said body causing said colored, non-toxic, gelatinous fluid to flow into said internal head cavity and out through said head portion orifices in an oozing fashion, said colored, gelatinous fluid being visible on the exterior of said head portion oozing from said head portion orifices enhancing the visual impact of the figure toy.

2. The figure toy of claim 1, wherein said body cavity is comprised of a hollow torso and solid extremities.

3. The figure toy of claim 1, wherein said head securing means is comprised of external threads.

4. The figure toy of claim 1, wherein said body securing means is comprised of internal threads.

5. The figure toy of claim 1, wherein said head orificies include aural, nasal, oral, and optic orifices.

6. The figure toy of claim 1, wherein said non-toxic gelatinous fluid is a red colored fluid to simulate blood.

7. A method of enhancing the visual impact of a humanoid figure toy, comprising the following steps:

a. providing a humanoid, monster-type figure toy comprised of a body fabricated from a durable and resilient material, said body having an internal body cavity, a head fabricated from a relatively rigid material and having an internal head cavity and a multiple number of head orifices located in analogous positions to at least two of the head orifices of the humanoid figure including the aural, nasal, oral and optic areas, said cavities and said head orifices being in fluid communication with one another, securing means for securing said head to said body, and a colored, non-toxic gelatinous fluid contained within said body cavity;

b. placing the humanoid, monster-type figure toy with said head secured to said body in a position to be squeezed by the user; and c. compressing said body by squeezing it until the colored, non-toxic gelatinous fluid flows from said internal body cavity into said head cavity and oozes out from said head cavity through said head orifices, the colored, gelatinous fluid oozing through said head orificies visually enhancing the visual impact of the humanoid, monster-type figure toy.

8. The method of claim 7, wherein there is further included the following steps:

d. collecting the discharged, colored gelatinous fluid;

e. removing said head and returning the gelatinous fluid to said body cavity;

f. re-securing said head to said body; and g. repeating steps "b" through "f" above to the pleasure of the user.

* * * * *